US012043988B2

(12) United States Patent
Hodel et al.

(10) Patent No.: US 12,043,988 B2
(45) Date of Patent: Jul. 23, 2024

(54) SELECTIVELY CAUSING REMOTE PROCESSING OF DATA FOR AN AUTONOMOUS DIGGING OPERATION

(71) Applicant: Caterpillar Inc., Peoria, IL (US)

(72) Inventors: Benjamin J. Hodel, Dunlap, IL (US); Matthew James Beschorner, Plainfield, IL (US)

(73) Assignee: Caterpillar Inc., Peoria, IL (US)

( * ) Notice: Subject to any disclaimer, the term of this patent is extended or adjusted under 35 U.S.C. 154(b) by 669 days.

(21) Appl. No.: 17/303,310

(22) Filed: May 26, 2021

(65) Prior Publication Data

US 2022/0381007 A1 Dec. 1, 2022

(51) Int. Cl.
*E02F 9/26* (2006.01)
*E02F 9/20* (2006.01)

(52) U.S. Cl.
CPC ..... *E02F 9/262* (2013.01); *E02F 9/2029* (2013.01); *E02F 9/2041* (2013.01); *E02F 9/205* (2013.01); *E02F 9/2054* (2013.01); *E02F 9/265* (2013.01)

(58) Field of Classification Search
CPC ..... E02F 9/262; E02F 9/2029; E02F 9/2041; E02F 9/205; E02F 9/2054; E02F 9/265;
(Continued)

(56) References Cited

U.S. PATENT DOCUMENTS 6,823,616 B1 * 11/2004 Gutter ..... E02F 9/2041 294/68.23
6,856,879 B2 2/2005 Arakawa et al.
(Continued)

FOREIGN PATENT DOCUMENTS

EP 2966612 A1 1/2016
EP 3228849 A1 10/2017
(Continued)

OTHER PUBLICATIONS

Kim et al, J. Action Recognition of Earthmoving Excavators Based on Sequential Pattern Analysis of Visual Features and Operation Cycles, Google Scholar, Elsevier, Automation in Construction, pp. 255-264. (Year: 2019).*
(Continued)

*Primary Examiner* — Russell Frejd

(57) ABSTRACT

A machine may include an implement; one or more sensor devices; and a controller. The controller may be configured to receive, from the one or more sensor devices, data regarding a ground surface on which the machine is to perform a digging operation; transmit the data to one or more remote computing devices to cause the one or more remote computing devices to generate digging information based on the data; and receive the digging information from the one or more remote computing devices. The digging information may include information identifying a sequence of digging locations in an area of the ground surface and information identifying corresponding dumping locations. Based on the digging information, the controller may be configured to cause the machine to navigate to a digging location of the digging locations, and cause the implement to initiate the digging operation at the digging location.

20 Claims, 3 Drawing Sheets

(58) Field of Classification Search
CPC ..... E02F 3/437; E02F 3/439; E02F 3/435; G05D 1/0282; G05D 1/0251
See application file for complete search history.

(56) References Cited

U.S. PATENT DOCUMENTS

| | | | | |
|---|---|---|---|---|
| 7,832,126 | B2 * | 11/2010 | Koellner | E02F 9/264 37/348 |
| 8,818,567 | B2 | 8/2014 | Anderson | |
| 10,066,367 | B1 | 9/2018 | Wang et al. | |
| 10,761,537 | B1 | 9/2020 | Ready-Campbell | |
| 2012/0130599 | A1 * | 5/2012 | Faivre | E02F 9/265 701/50 |
| 2017/0103580 | A1 | 4/2017 | Petrany et al. | |
| 2021/0034058 | A1 | 2/2021 | Subramanian et al. | |

FOREIGN PATENT DOCUMENTS

| | | | |
|---|---|---|---|
| JP | 0566277 | A | 3/1993 |
| WO | 2019/012988 | A1 | 1/2019 |
| WO | 2020196674 | A1 | 10/2020 |
| WO | 2021096549 | A1 | 5/2021 |

OTHER PUBLICATIONS

Wu et al, Y. Construction of Stretching-Bending Sequential Pattern to Recognize Work Cycles for Earthmoving Excavator from Long Video Sequences, Google Scholar, MDPI, Sensors, May 2021, pp. 1-17. (Year: 2021).*

Jud et al, D. Autonomous Free-Form Trenching Using a Walking Excavator, Google Scholar, IEEE Robotics and Automation Letters, vol. 4, No. 4, Oct. 2019, pp. 3208-3215. (Year: 2019).*

Trevithick, "U-2 Spy Plane Taps Into Computers on the Ground to Expand Data Processing Ability Mid-Mission," The Drive, Dec. 2020, 14 pages [retrieved from https://www.thedrive.com/the-war-zone/38162/u-2-spy-plane-taps-into-computers-on-the-ground-to-help-process-sensor-data-mid-mission on May 19, 2021].

"VIPER's Mission Operations," National Aeronautics and Space Administration, edited by Rick Chen, Feb. 2021, 8 pages [retrieved from https://www.nasa.gov/viper/lunar-operations on Apr. 23, 2021].

Galceran et al., "A Survey on Coverage Path Planning for Robotics," University of Girona—Underwater Robotics Research Center (CIRS), Aug. 2013, 37 pages.

Written Opinion and International Search Report for Int'l. Patent Appln. No. PCT/US2022/030209, dated Aug. 26, 2022 (13 pgs).

* cited by examiner

SELECTIVELY CAUSING REMOTE PROCESSING OF DATA FOR AN AUTONOMOUS DIGGING OPERATION

TECHNICAL FIELD

The present disclosure relates generally to autonomously performing a digging operation and, for example, to determining whether to cause remote processing of data (from multiple sensor devices) for autonomous performance of the digging operation.

BACKGROUND

An excavator may perform a digging operation at a job site. Typical computing devices, of the excavator, may enable an implement, of the excavator, to be adjusted during an autonomous operation (e.g., during autonomous performance of the digging operation). However, the typical computing devices are subject to computational constraints that prevent the typical computing devices from performing computationally complex and time-consuming tasks. For example, the computational constraints prevent the typical computing devices from processing sensor data, from a plurality of sensor devices (e.g., of the excavator), to determine an optimal sequence of digging locations and dumping locations for the digging operation (e.g., for the autonomous performance of the digging operation). Furthermore, the excavator may be used in rugged and harsh conditions that may cause the typical computing devices to fail prematurely.

U.S. Pat. No. 10,066,367 (the '367 patent) discloses a system configured to be mounted to a vehicle for adjusting a position of an implement during an autonomous operation being performed by the vehicle. The '367 patent discloses that the vehicle may monitor a height, slope angle, and/or load of an implement during an operation and adjust one or more parameters associated with the implement to achieve a desired finishing profile. While the '367 patent discloses adjusting the position of the implement during the autonomous operation, the '367 patent does not address the computational constraints (e.g., relating to autonomous operations), does not address determining a sequence of digging locations and dumping locations for a digging operation, and does not address other limitations of the typical computing devices set forth above.

The present disclosure solves one or more of the problems set forth above and/or other problems in the art.

SUMMARY

A method performed by a controller of a machine includes receiving, from one or more sensor devices, first data regarding a ground surface on which the machine is to perform a digging operation; determining that the first data can be transmitted to one or more remote computing devices to cause the one or more remote computing devices to generate digging information; transmitting the first data to the one or more remote computing devices based on determining that the first data can be transmitted; receiving the digging information from the one or more remote computing devices, wherein the digging information includes information identifying a sequence of digging locations and information identifying corresponding dumping locations; causing an implement, of the machine, to initiate the digging operation on the ground surface based on the digging information; transmitting second data, regarding the ground surface, to the one or more remote computing devices, after initiating the digging operation; receiving, from the one or more remote computing devices, updated digging information generated based on the second data; and causing the machine to adjust the digging operation based on the updated digging information.

A system comprises: a controller configured to: receive, from one or more sensor devices, data regarding a ground surface on which a machine is to perform a digging operation; transmit the data to one or more remote computing devices to cause the one or more remote computing devices to generate digging information for the digging operation based on the data; receive the digging information, from the one or more remote computing devices, based on the digging information, wherein the digging information includes information identifying a sequence of digging locations in an area of the ground surface and information identifying an orientation of the machine at each digging location of a subset of the digging locations; and based on the digging information: cause the machine to navigate to a digging location of the subset of the digging locations and to be oriented in accordance with the orientation at the digging location, and cause an implement, of the machine, to perform the digging operation at the digging location.

A machine includes an implement; one or more sensor devices; and a controller configured to: receive, from the one or more sensor devices, data regarding a ground surface on which the machine is to perform a digging operation; transmit the data to one or more remote computing devices to cause the one or more remote computing devices to generate digging information based on the data; receive the digging information from the one or more remote computing devices, wherein the digging information includes information identifying a sequence of digging locations in an area of the ground surface and information identifying corresponding dumping locations; and based on the digging information: cause the machine to navigate to a digging location of the digging locations, and cause the implement to initiate the digging operation at the digging location.

DETAILED DESCRIPTION

Figure 1:
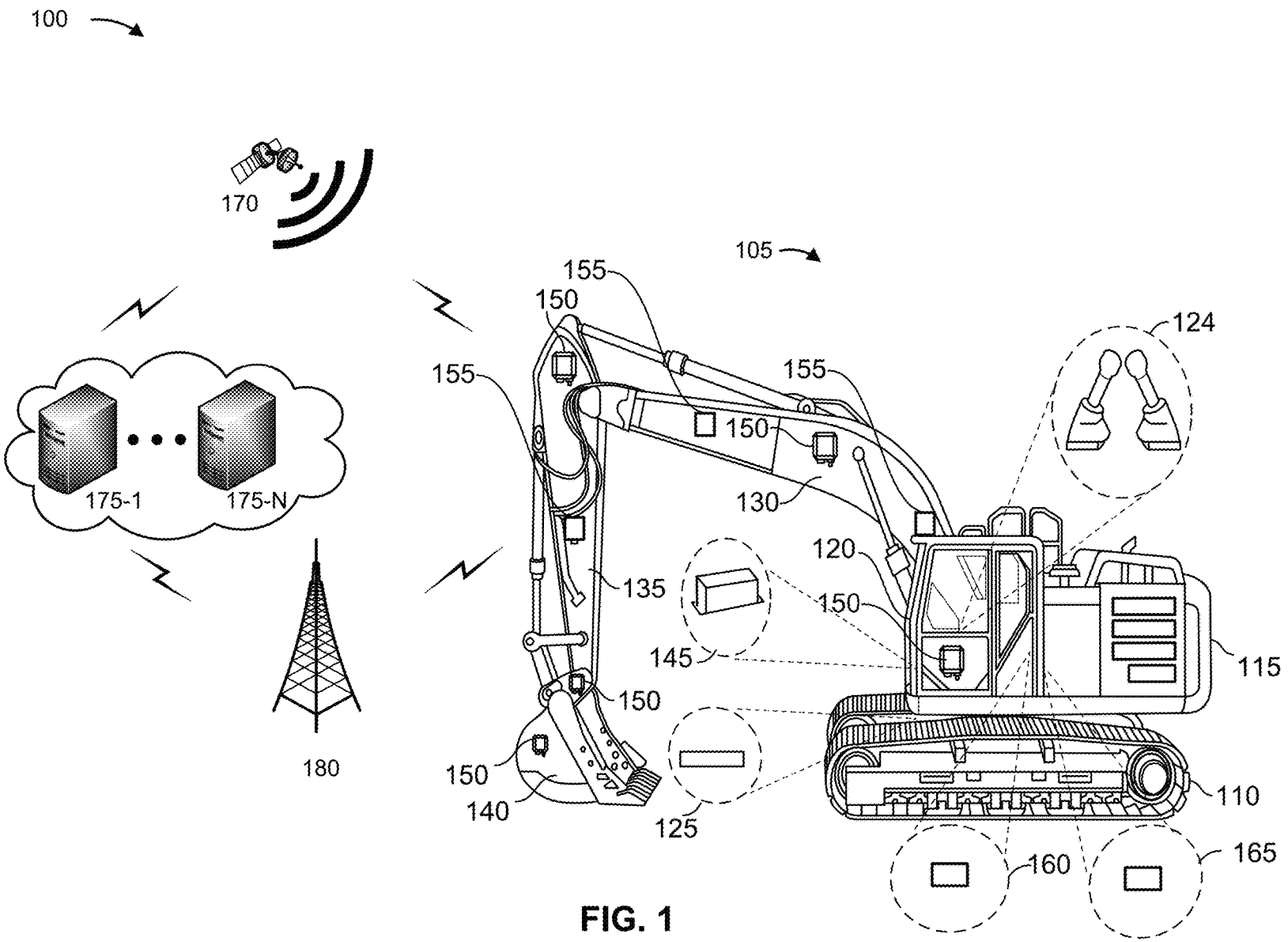
FIG. 1 is a diagram of an example implementation described herein.

The present disclosure is directed to a machine that causes one or more remote computing devices to generate digging information based on data regarding a ground surface on which the machine is to perform a digging operation. The data may be obtained from one or more sensor devices provided on different portions of the machine (e.g., provided on a boom, a stick, and/or an implement). As an example, the one or more sensor devices may include, for example, one or more stereoscopic ("stereo") cameras and the data may include one or more images of the ground surface. The data may be transmitted to the one or more remote computing devices via a satellite device configured for high-speed communication or via a cellular network configured for high-speed communication (e.g., a 5G network). The one or more remote computing devices may include one or more cloud computing devices (e.g., one or more high-performance remote computing devices).

The one or more remote computing devices may generate the digging information based on the data. The digging information may include information identifying a sequence of digging locations (and paths between consecutive digging locations), information identifying corresponding dumping locations, suggested machine pose data identifying an orientation of the machine at each digging location, suggested implement pose data identifying a position and/or an orientation of the implement of the machine at each digging location, suggested linkage pose data identifying a position and/or an orientation of a boom and/or a stick of the machine at each digging location, information identifying a volume of material to be dug (or removed) at each digging location, among other examples.

When generating the digging information, the one or more remote computing devices may determine (or identify) a plurality of sequences of digging locations (and paths between the digging locations) and identify an optimal sequence of digging locations by taking into consideration different factors. The different factors may include minimal dig cycle times, maximum fuel economy, minimal implement wear, among other examples. A dig cycle may include a combination of actions by the machine, such as the machine digging material, swinging, and dumping the material. The different factors may be configurable by a user (e.g., by an operator of the machine). For example, the different factors may be configurable based on a type of the machine, based on an amount of usage of the machine, based on a geographic area in which the machine is located, based on a weather condition in the geographic area, based on a day and/or a time during which the digging operation is being performed, among other examples. The optimal sequence of digging locations may correspond to the sequence of digging locations included in the digging information. The digging information may be transmitted (e.g., via the satellite device or the cellular network) to the machine to facilitate the digging operation. Further, it will be understood that the terms "digging" and "digging operation" are used broadly and, as outlined above, encompass the dumping of material previously gathered by the work machine.

In some situations, the machine may suspend transmission of and buffer the data in the event of an outage of wireless communication or in the event the wireless connection is established and a rate of data transmission (of the wireless connection) does not satisfy a transmission rate threshold. The machine may resume transmission of the data when the wireless communication is re-established or when the rate of data transmission (of the wireless connection) satisfies the transmission rate threshold. In some instances, in the event of the outage of wireless communication or in the event of the rate of data transmission not satisfying the transmission rate threshold, the machine may suspend an operation (of the machine) that relies on the processed data (e.g., suspend the digging operation, suspend a navigation operation, among other examples). In some examples, when the data cannot be transmitted to the one or more remote computing devices, the data may be processed locally on the machine. Additionally, the machine may provide a notification (e.g., in an operator cabin of the machine) indicating that the data cannot be transmitted to the one or more remote computing devices and/or that the data is being processed locally on the machine.

The term "machine" may refer to a machine that performs an operation associated with an industry such as, for example, mining, construction, farming, transportation, or another industry. Moreover, one or more implements may be connected to the machine. As an example, a machine may include a construction vehicle, a work vehicle, or a similar vehicle associated with the industries described above.

FIG. 1 is a diagram of an example implementation 100 described herein. As shown in FIG. 1, the example implementation 100 includes a machine 105. Machine 105 is embodied as an earth moving machine, such as an excavator. Alternatively, the machine 105 may be another type of machine, such as a dozer.

As shown in FIG. 1, machine 105 includes ground engaging members 110, a machine body 115, an operator cabin 120, and a swivel element 125. Ground engaging members 110 may include tracks (as shown in FIG. 1), wheels, rollers, and/or the like, for propelling machine 105. Ground engaging members 110 are mounted on a subframe bearing the swivel element (not shown) and are driven by one or more engines and drivetrains (not shown). Machine body 115 is mounted on a rotatable frame that is attached to the swivel element carried by the subframe so that operator cabin 120 and machine body 115 are rotatable relative to the subframe and ground engaging members 110. Operator cabin 120 is supported by machine body 115 mounted on the rotatable frame. Operator cabin 120 includes an integrated display (not shown) and operator controls 124, such as, for example, an integrated joystick. Operator controls 124 may include one or more input components.

For an autonomous machine, operator controls 124 may not be designed for use by an operator located in the operator cabin 120 and, rather, may be designed to operate independently from an operator in the work machine 105. In this case, for example, operator controls 124 may include one or more input components that provide an input signal for use by another component without any operator input. Swivel element 125 may include one or more components that enable the rotating frame (and machine body 115) to rotate (or swivel). For example, swivel element 125 may enable the rotating frame (and machine body 115) to rotate (or swivel) with respect to ground engaging members 110.

As shown in FIG. 1, machine 105 includes a boom 130, a stick 135, and a machine work tool 140. Boom 130 is pivotally mounted at its proximal end to machine body 115, and is articulated relative to machine body 115 by one or more fluid actuation cylinders (e.g., hydraulic or pneumatic cylinders), electric motors, and/or other electro-mechanical components. Stick 135 is pivotally mounted at a distal end of boom 130 and is articulated relative to boom 130 by one or more fluid actuation cylinders, electric motors, and/or other electro-mechanical components. Boom 130 and/or stick 135 may be referred to as a linkage. Machine work tool 140 is mounted at a distal end of stick 135 and may be articulated relative to stick 135 by one or more fluid actuation cylinders, electric motors, and/or other electro-mechanical components. Machine work tool 140 may be a bucket (as shown in FIG. 1) or another type of tool or implement that may be mounted on stick 135. Machine work tool 140 may be referred to as an implement.

As shown in FIG. 1, machine 105 includes a controller 145 (e.g., an electronic control module (ECM), a computer vision controller, an autonomy controller, among other examples), one or more inertial measurement units (IMUs) 150 (referred to herein individually as "IMU 150," and collectively referred to as "IMUs 150"), one or more stereo cameras 155, a wireless communication component 160, and one or more sensor devices 165. Controller 145 may control and/or monitor operations of machine 105. For example, controller 145 may control and/or monitor the operations of machine 105 based on signals from operator controls 124, signals from IMUs 150, signals from stereo cameras 155, signals from wireless communication component 160, and/or signals from one or more sensor devices 165.

As shown in FIG. 1, IMUs 150 are installed at different positions on components or portions of machine 105, such as, for example, on machine body 115, boom 130, stick 135, and machine work tool 140. An IMU 150 includes one or more devices that are capable of receiving, generating, storing, processing, and/or providing signals indicating a position and orientation of a component, of machine 105, on which the IMU 150 is installed. For example, IMU 150 may include one or more accelerometers and/or one or more gyroscopes. The one or more accelerometers and/or the one or more gyroscopes generate and provide signals that can be used to determine a position and orientation of the IMU 150 relative to a frame of reference and, accordingly, a position and orientation of the component. While the example discussed herein refers to IMUs 150, the present disclosure is applicable to using one or more other types of sensor devices that may be used to determine a position and orientation of a component of machine 105.

One or more first IMUs 150 may be located on boom 130 and/or stick 135. The one or more first IMUs 150 may generate signals that may be used to determine a position and/or an orientation of boom 130 and/or stick 135 and the signals may be used to generate linkage pose data that indicates the position and/or the orientation of boom 130 and/or stick 135. One or more second IMUs 150 may be located on machine work tool 140. The one or more second IMUs 150 may generate signals that may be used to determine a position and/or an orientation of machine work tool 140 and the signals may be used to generate implement pose data that indicates the position and/or the orientation of machine work tool 140. One or more third IMUs 150 may be located on machine body 115. The one or more third IMUs 150 may generate signals that may be used to determine a position and/or an orientation of machine body 115 and the signals may be used to generate machine pose data that indicates the position and/or the orientation of machine body 115.

IMUs 150 may provide the linkage pose data, the implement pose data and/or the machine pose data to controller 145 periodically (e.g., every thirty seconds, every minute, every two minutes, among other examples). Additionally, or alternatively, IMUs 150 may provide the linkage pose data, the implement pose data and/or the machine pose data to controller 145 based on a triggering event. A triggering event, as used herein, may include a request from controller 145, detecting a movement of machine body 115, detecting a movement of machine work tool 140, detecting a movement of boom 130 and/or stick 135, a request from the operator, a request from the back office system, machine 105 initiating a new task, machine 105 relocating to a different geographical location, after machine 105 has completed a dig cycle, after machine work tool 140 has completed a dig and/or during a swing prior to a dump of material, among other examples.

Stereo camera 155 may include one or more devices that are capable of obtaining and providing data of an environment that includes a ground surface on which machine 105 is to perform a digging operation. The data may include image data (e.g., three-dimensional (3D) image data) of the environment. Stereo camera 155 may provide the data to controller 145 periodically (e.g., every second, every other second, among other examples) and/or based on a triggering event. While the example discussed herein refers to stereo camera 155, the present disclosure is applicable to using one or more other types of devices, such as non-stereo cameras, a light detection and ranging (LIDAR) device, and/or a radio detection and ranging (RADAR) device, among other examples of devices (e.g., sensor devices) that are configured to provide data regarding the environment. Unless specifically stated otherwise, any following reference to a stereo camera 155 should be understood to encompass these other devices.

FIG. 1 shows stereo cameras 155 being provided on boom 130, stick 135, and machine work tool 140. In practice, machine 105 may include one or more additional stereo cameras 155, fewer stereo cameras 155, and/or differently arranged stereo cameras 155 (e.g., stereo cameras 155 provided on other portions of machine 105).

Wireless communication component 160 includes one or more devices that enable machine 105 to communicate with other devices, as described herein. Wireless communication component 160 may include a transceiver, a separate transmitter and receiver, an antenna, a Bluetooth transceiver or another type of wireless local area network transceiver, among other examples. Wireless communication component 160 may transmit the data (e.g., from one or more stereo cameras 155) to one or more remote computing devices, and may receive digging information from the one or more remote computing devices, as described herein. The digging information may be used by controller 145 to cause machine 105 to perform the digging operation on the ground surface.

Wireless communication component 160 may be configured to transmit the data as a continuous flow of data from one or more stereo cameras 155, or, alternatively, in transmission bursts. In some examples, wireless communication component 160 may transmit the data and may receive the digging information via a satellite device, via a base station, and/or via another device that may enable wireless communication component 160 to transmit data to and receive data from the one or more remote computing devices, as described below.

Wireless communication component 160 may communicate with the one or more remote computing devices via a network that includes one or more wired and/or wireless networks, such as a cellular network (e.g., a 5G network, a long-term evolution (LTE) network, a code division multiple access (CDMA) network, a 3G network, a 4G network, or another type of cellular network), the Internet, a cloud computing network, a wireless local area network (LAN), an intranet, a fiber optic-based network, a wide area network (WAN), a public land mobile network (PLMN), a metropolitan area network (MAN), a telephone network (e.g., the Public Switched Telephone Network (PSTN)), a private network, and an ad hoc network, among other examples, and/or a combination of these or other types of networks.

Wireless communication component 160 may enable machine 105 to communicate (e.g., via Bluetooth or another type of wireless local area network) with one or more other machines that are separate from machine 105. For example, wireless communication component 160 may receive external machine data from one or more sensor devices of the one or more other machines, as described herein. The external machine data may include data regarding the ground surface. The external machine data may identify one or more views of the ground surface that are different than one or more views identified by the data from one or more stereo cameras 155.

Additionally, or alternatively, to receiving the external data, wireless communication component 160 may transmit instructions (e.g., from controller 145) to the one or more other machines to cause the one or more other machines to transmit the external machine data to the one or more remote computing devices, as described herein. In some instances, the data (e.g., from one or more stereo cameras 155) and the external machine data may form a comprehensive view of the ground surface. The one or more remote computing devices may process the data (from e.g., from one or more stereo cameras 155) and the external machine data to generate the digging information, as described herein.

Sensor device 165 includes one or more devices that are capable of receiving, generating, storing, processing, and/or providing signals regarding one or more components of machine 105. For example, sensor device 165 may include a hydraulic displacement sensor, a pressure sensor (e.g., for a hydraulic cylinder), a soil moisture sensor, a machine speed sensor, an engine speed sensor, and/or a global positioning system (GPS) device, among other examples.

As further shown in FIG. 1, the example implementation 100 involves a satellite device 170, and includes one or more remote computing devices 175-1 through 175-N (N≥1) (hereinafter referred to collectively as remote computing devices 175, and individually as remote computing device 175), and also involves a base station 180. Satellite device 170 may include one or more devices that are configured for high-speed communication (e.g., a geostationary satellite that is configured for high-speed communication). For example, satellite device 170 may be configured to provide high-speed Internet access (e.g., to machine 105 via wireless communication component 160).

Remote computing device 175 may include one or more devices that are configured to generate the digging information based on the data and/or the external machine data as explained herein. Remote computing device 175 may be implemented as a single computing device (e.g., a single server) or multiple computing devices (e.g., multiple servers), such as multiple computing devices in one or more data centers. In some examples, remote computing device 175 may be included in a cloud computing environment. Additionally, or alternatively, remote computing device 175 may be included in a back office system.

Base station 180 may be connected to a cellular network (e.g., described above). For example, base station 180 may be connected to a 5G network. Base station 180 may include a base transceiver station, a radio base station, a node B, an evolved node B (eNB), a next generation node B (gNB), a base station subsystem, a cellular site, a cellular tower (e.g., a cell phone tower, a mobile phone tower, and/or the like), an access point, a transmit receive point (TRP), a radio access node, a macrocell base station, a microcell base station, a picocell base station, and/or a femtocell base station, or a similar type of device.

As indicated above, FIG. 1 is provided as an example. Other examples may differ from what was described in connection with FIG. 1.

Figure 2:
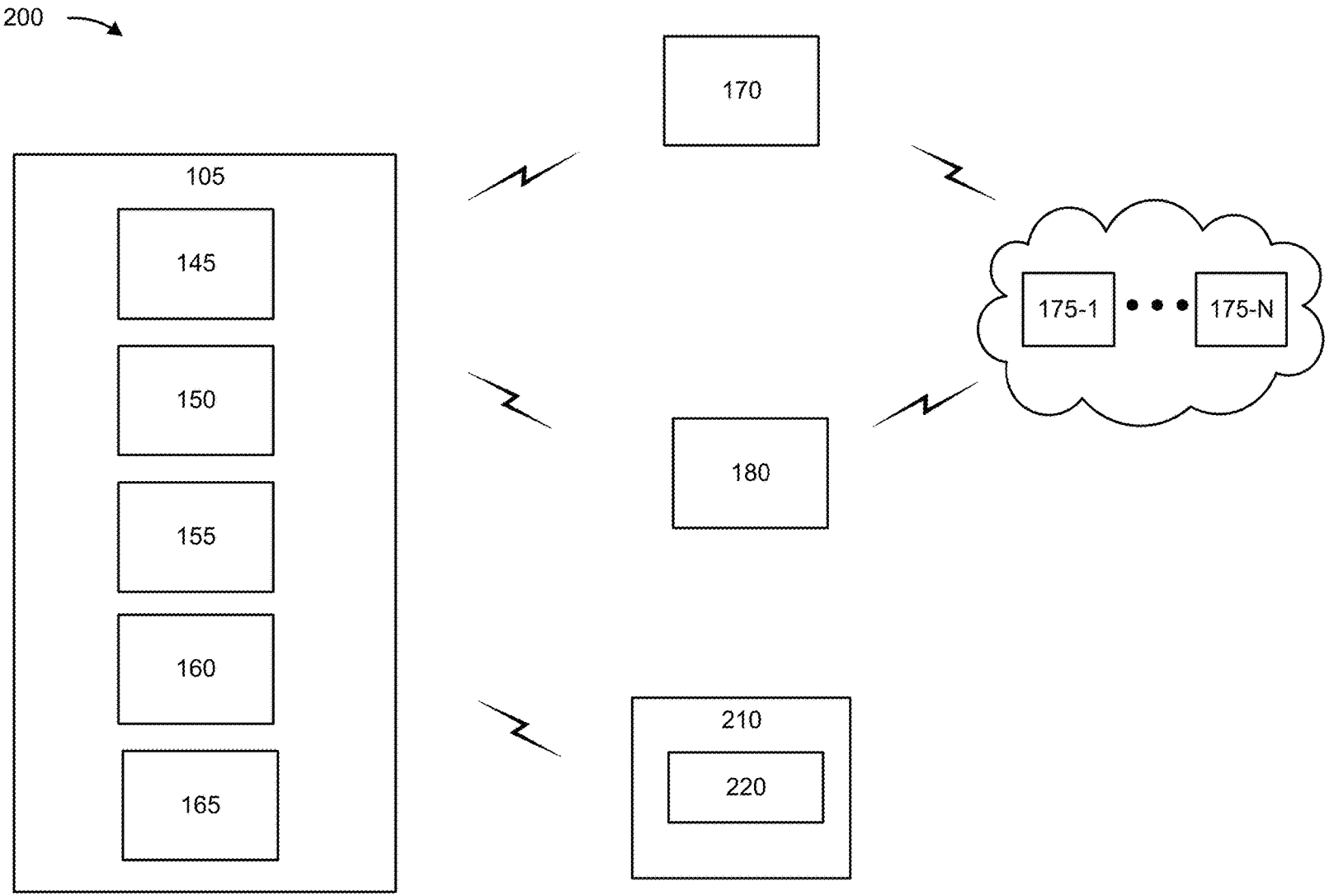
FIG. 2 is a diagram of an example system described herein.

FIG. 2 is a diagram of an example system 200 described herein. As shown in FIG. 2, system 200 includes controller 145, IMU 150, stereo camera 155, wireless communication component 160, one or more sensor devices 165, one or more remote computing devices 175. System 200 may be associated with satellite device 170, base station 180, and a machine 210 that includes a sensor device 220, without regard to ownership. Machine 210 may be similar to or different than machine 105. For example, in a situation where machine 105 is an excavator, machine 205 may be a different excavator or a different type of machine, such as a dump truck. Sensor device 220 may include a stereo camera, a LIDAR device, a radio detection and ranging (RADAR) device, among other examples.

Wireless communication component 160 may be configured to establish a wireless connection with one or more remote computing devices 175 via satellite device 170 or via base station 180 (e.g., establish the wireless connection with satellite device 170 or with base station 180, which in turn establish wireless connection with the one or more remote computing devices). Wireless communication component 160 may be configured to attempt to establish the wireless connection periodically (e.g., every thirty seconds, every minute, among other examples) and/or based on a triggering event (e.g., based on a request from controller 145, based on receiving an indication that machine 105 is operating in an autonomous mode, based on wireless communication component 160 being initiated, among other examples).

Wireless communication component 160 may transmit, via the wireless connection, the data (obtained by one or more stereo cameras 155) to the one or more remote computing devices 175 for processing. The one or more remote computing devices 175 may process the data to generate processed data and wireless communication component 160 may receive the processed data from the one or more remote computing devices 175 via the wireless connection.

Wireless communication component 160 may be configured to prioritize establishing the wireless connection with satellite device 170 (e.g., over establishing the wireless connection with base station 180). For example, wireless communication component 160 may be configured to establish the wireless connection with satellite device 170 if the signal strength of base station 180 does not exceed the signal strength of satellite device 170 by a threshold difference. As another example, wireless communication component 160 may be configured to establish the wireless connection with satellite device 170 if the signal strength of satellite device 170 satisfies a criterion irrespective of the signal strength of base station 180.

Wireless communication component 160 may be preconfigured with information identifying the threshold difference, may receive the information identifying the threshold difference from a device of an operator of machine 105, and may receive the information identifying the threshold difference from the back office system, among other examples. Alternatively to prioritizing establishing the wireless connection with satellite device 170, wireless communication component 160 may be configured to prioritize establishing the wireless connection with base station 180 (e.g., over establishing the wireless connection with satellite device 170) in a manner similar to the manner described above in connection with satellite device 170.

In some implementations, wireless communication component 160 may be configured to establish the wireless connection based on the relative signal strength of satellite device 170 and the signal strength of base station 180. For example, wireless communication component 160 may be configured to establish the wireless connection with satellite device 170 when the signal strength of satellite device 170 exceeds the signal strength of base station 180. Alternatively, wireless communication component 160 may be configured to establish the wireless connection with base station 180 when the signal strength of base station 180 exceeds the signal strength of satellite device 170.

Wireless communication component 160 (and/or controller 145) may periodically (e.g., every fifteen seconds, every thirty seconds, among other examples) determine the signal strength of satellite device 170 and the signal strength of base station 180. In this regard, wireless communication component 160 may periodically alternate between establishing the wireless connection with satellite device 170 or establishing the wireless connection with base station 180 based on periodically determining the signal strength of satellite device 170 and the signal strength of base station 180.

As an example of periodically alternating establishing the wireless connection, assume that wireless communication component 160 has established the wireless connection with satellite device 170. Wireless communication component 160 may terminate the wireless connection with satellite device 170 and establish the wireless connection with base station 180 if wireless communication component 160 (and/or controller 145) determines that the signal strength of base station 180 exceeds the signal strength of satellite device 170 (and vice versa).

Additionally, or alternatively, to determining the signal strengths periodically, wireless communication component 160 (and/or controller 145) may determine the signal strength of satellite device 170 and the signal strength of base station 180 based on a triggering event (e.g., based on a request from controller 145, based on an indication of a change of an operation of machine 105, among other examples). Wireless communication component 160 may alternate between establishing the wireless connection with satellite device 170 or establishing the wireless connection with base station 180 based on the triggering event.

By alternating (e.g., periodically and/or based on the triggering event) between establishing the wireless connection with satellite device 170 or establishing the wireless connection with base station 180, wireless communication component 160 may maintain communication with the one or more remote computing devices 175 and attempt to minimize disruption of transmitting the data and/or receiving the digging information. By preventing any disruption of transmitting the data and/or receiving the digging information, wireless communication component 160 and/or controller 145 may prevent any disruption of an operation performed by machine 105.

In some examples, wireless communication component 160 may determine that the wireless connection cannot be established with satellite device 170 when the signal strength of satellite device 170 does not satisfy a signal strength threshold. Similarly, wireless communication component 160 may determine that the wireless connection cannot be established with base station 180 when the signal strength of base station 180 does not satisfy the signal strength threshold. Controller 145 may determine that the data is to be processed locally on machine 105 when neither the signal strength of satellite device 170 nor the signal strength of base station 180 satisfies the signal strength threshold. Wireless communication component 160 may be pre-configured with information identifying the signal strength threshold, may receive the information identifying the signal strength threshold from a device of the operator, may receive the information identifying the signal strength threshold from the back office system, among other examples.

Wireless communication component 160 may be configured to establish the wireless connection based on an output of a machine learning model. For example, wireless communication component 160 (and/or controller 145) may use the machine learning model to predict whether wireless communication component 160 is to establish the wireless connection with satellite device 170, whether wireless communication component 160 is to establish the wireless connection with base station 180, or whether wireless communication component 160 is not to establish the wireless connection with satellite device 170 or base station 180.

For instance, controller 145 may provide as an input, to the machine learning model, information identifying a current geographical location and/or a current geographical area of machine 105, information identifying one or more obstructions in the current geographical location and/or the current geographical area (e.g., one or more images of the one or more obstructions), information identifying a time of day, and/or information identifying a predicted weather condition, among other examples. The input may be obtained from a device of the operator, from one or more stereo cameras 155, and/or from one or more sensor devices 165, among other examples. Based on the input, the machine learning model may provide, as an output, predicted connection information indicating whether wireless communication component 160 is to establish the wireless connection with satellite device 170, is to establish the wireless connection with base station 180, or is not to establish the wireless connection with satellite device 170 or base station 180.

The machine learning model may be trained using historical data that includes historical data of geographical locations and/or geographical areas, historical data (e.g., images) of obstructions in the historical geographical locations and/or geographical areas, historical times of the day, historical data of weather conditions at the historical geographical locations and/or geographical areas, historical signal strengths of satellite device 170 and base station 180 at the historical geographical locations and/or geographical areas (e.g., in light of the historical obstructions, the historical times, the historical weather conditions, among other examples), historical latencies of satellite device 170 and base station 180 at the historical geographical locations and/or geographical areas, and/or historical data indicating the wireless connections that were established (e.g., satellite device 170 or base station 180), among other examples.

The machine learning model may be generated and trained by a trainer device, which may be a discrete hardware component or software component (not shown). The trainer device may be included in the back office system, or may be included in the one or more remote computing devices 175, among other examples. The trainer device may provide the machine learning model to machine 105 for use by controller 145 and/or wireless communication component 160. The trainer device may update and provide (e.g., on a scheduled basis, on an on-demand basis, on a triggered basis, and/or on a periodic basis, among other examples) the machine learning model to machine 105. In some instances, controller 145 may obtain additional training data (e.g., additional historical data similar to the historical data described above) and cause the machine learning model to be retrained based on the additional training data. For example, controller 145 may provide the additional training data to the trainer device to retrain the machine learning model. The machine learning model may be retrained on a periodic basis and/or based on a triggering event. In some situations, the machine learning model may be implemented on the one or more remote computing devices 175.

When training the machine learning model, the trainer device may portion the training data into a training set (e.g., a set of data to train the machine learning model), a validation set (e.g., a set of data used to evaluate a fit of the machine learning model and/or to fine tune the machine learning model), a test set (e.g., a set of data used to evaluate a final fit of the machine learning model), and/or the like. The trainer device may preprocess and/or perform dimensionality reduction to reduce the training data to a minimum feature set. The trainer device may train the machine learning model on this minimum feature set, thereby reducing processing to train the machine learning model, and may apply a classification technique, to the minimum feature set.

The trainer device may use a classification technique, such as a logistic regression classification technique, a random forest classification technique, a gradient boosting machine learning (GBM) technique, and/or the like, to determine a categorical outcome (e.g., whether to establish the wireless connection with satellite device 170 or base station 180). In addition to, or as an alternative to use the classification technique, the trainer device may use a naïve Bayesian classifier technique. In this case, the device may perform binary recursive partitioning to split the training data of the minimum feature set into partitions and/or branches and use the partitions and/or branches to perform predictions (e.g., whether to establish the wireless connection with satellite device 170 or base station 180). Based on using recursive partitioning, the trainer device may reduce utilization of computing resources relative to manual, linear sorting and analysis of data items, thereby enabling use of thousands, millions, or billions of data items to train a model, which may result in a more accurate model than using fewer data items.

The trainer device may train the machine learning model using a supervised training procedure that includes receiving input to the machine learning model from a subject matter expert (e.g., one or more operators associated with machine 105 and/or the one or more machines), which may reduce an amount of time, an amount of processing resources, and/or the like to train the machine learning model relative to an unsupervised training procedure. The trainer device may use one or more other model training techniques, such as a neural network technique, a latent semantic indexing technique, and/or the like.

For example, the trainer device may perform an artificial neural network processing technique (e.g., using a two-layer feedforward neural network architecture, a three-layer feedforward neural network architecture, and/or the like) to perform pattern recognition with regard to patterns of establishing the wireless connection with satellite device 170 or base station 180. In this case, using the artificial neural network processing technique may improve an accuracy of the machine learning model generated by the trainer device by being more robust to noisy, imprecise, or incomplete data, and by enabling the trainer device to detect patterns and/or trends undetectable to human analysts or systems using less complex techniques.

In the example that follows, assume that machine 105 is located on a ground surface of a job site and that machine 105 is to perform a digging operation (e.g., autonomously or semi-autonomously) in an area of the ground surface. Further assume that one or more stereo cameras 155 have obtained data regarding the ground surface and have provided the data to controller 145, in a manner similar to the manner described above. Controller 145 may receive the data from one or more stereo cameras 155 and determine whether to cause the data to be transmitted to one or more remote computing devices 175 for processing to generate the digging information or cause the data to be processed locally on machine 105.

As part of determining whether to cause the data to be transmitted to the one or more remote computing devices 175 for processing or cause the data to be processed locally on machine 105, controller 145 may determine whether the wireless connection is viable. The wireless connection may be viable when wireless communication component 160 can establish the wireless connection with satellite device 170 or base station 180 or when wireless communication component 160 has established the wireless connection and a rate of data transmission (of the wireless connection) satisfies a transmission rate threshold. The transmission rate threshold may be determined by the operator, may be determined by the back office system, may be stored in a memory of machine 105, among other examples. Controller 145 may cause wireless communication component 160 to transmit the data, via the wireless connection, to the one or more remote computing devices 175 when the wireless connection is viable. Alternatively, controller 145 may cause the data to be processed locally on machine 105 when the wireless connection is not viable. The wireless connection may not be viable when wireless communication component 160 cannot establish the wireless connection with satellite device 170 or base station 180 or when wireless communication component 160 has established the wireless connection and the rate of data transmission does not satisfy the transmission rate threshold.

In some examples, controller 145 may receive, from wireless communication component 160, wireless connection information indicating whether the wireless connection is viable and controller 145 may determine whether the wireless connection is viable based on the wireless connection information. In some examples, controller 145 may determine whether wireless communication component 160 needs to establish the wireless connection (e.g., with satellite device 170 or base station 180) and may provide an instruction, to wireless communication component 160, to establish the wireless connection based on determining whether wireless communication component 160 is to establish the wireless connection with satellite device 170 or with base station 180.

Controller 145 may receive the wireless connection information from wireless communication component 160 after providing the instruction and may determine whether the wireless connection is viable based on the wireless connection information. Alternatively to providing the instruction based on determining whether wireless communication component 160 needs to establish the wireless connection, controller 145 may provide the instruction, to wireless communication component 160, to establish the wireless connection without determining whether wireless communication component 160 is able to establish the wireless connection. For example, controller 145 may provide the instruction based on receiving the data.

As part of determining whether wireless communication component 160 is to establish the wireless connection, controller 145 may obtain information identifying the signal strength of satellite device 170 or information identifying the signal strength of base station 180 from wireless communication component 160. Controller 145 may provide the instruction, to wireless communication component 160, to establish the wireless connection when the signal strength of satellite device 170 or the signal strength of base station 180 satisfies the signal strength threshold. Conversely, controller 145 may determine that wireless communication component 160 is not able to establish the wireless connection (e.g., with satellite device 170 or with base station 180) when neither the signal strength of satellite device 170 nor the signal strength of base station 180 satisfies the signal strength threshold. Controller 145 may determine that the data (from one or more stereo cameras 155) is to be processed locally based on determining that wireless communication component 160 is not able to establish the wireless connection.

Assume that controller 145 provides the instruction to wireless communication component 160 to establish the wireless connection. Based on the instruction, controller 145 may establish the wireless connection (e.g., with satellite device 170 or with base station 180) in a manner similar to the manner described above and provide an indication that the wireless connection is established. Assume that controller 145 determines that the wireless connection has been established (e.g., based on the indication from wireless communication component 160). Based on determining that the wireless connection is viable, controller 145 may cause wireless communication component 160 to transmit, via the wireless connection, the data (from one or more stereo cameras 155) to the one or more remote computing devices 175 for processing.

The data may include the images obtained by one or more stereo cameras 155 and/or a disparity map generated based on the images. In some instances, machine 105 may include a LIDAR device. In such instances, the data may include a 3D point cloud of the environment based on data obtained by the LIDAR device (e.g., based on two-and-half dimensional data).

In some instances, controller 145 may receive an indication that wireless communication component 160 has received external machine data from one or more sensor devices 220 of one or more other machines 210. The external machine data may include data regarding the ground surface. Controller 145 may cause wireless communication component 160 to transmit, via the wireless connection, the external machine data to the one or more remote computing devices 175. Additionally, or alternatively, controller 145 may cause wireless communication component 160 to transmit instructions, to the one or more other machines 210, to cause the one or more other machines 210 to transmit the external machine data to the one or more remote computing devices 175. The data and/or the external machine data may be transmitted to the one or more remote computing devices 175 periodically (e.g., every five seconds, ten seconds, among examples) and/or based on a triggering event.

Controller 145 may cause wireless communication component 160 to transmit to the one or more remote computing devices 175, via the wireless connection, expected metrics information regarding the digging operation. The expected metrics information may include information identifying different types of metrics, such as information identifying an expected amount of time for each dig cycle, an expected volume of material to be removed during each dig cycle, an expected amount of time for completing the digging operation in the area, an expected amount of fuel to be consumed during each dig cycle and/or during the digging operation, an expected amount of implement wear during each dig cycle and/or during the digging operation, among other examples. In some examples, the expected metrics information may include information identifying a first weight for the expected amount of time for each dig cycle, information identifying a second weight for the expected volume of material to be removed during each dig cycle, and so on. One or more of the weights may be different from one or more other weights.

The weights may be provided by a device of the operator, by the back office system, among other examples. The weights may be based on a machine type of machine 105, based on a geographic area in which machine 105 is located, based on a day and/or a time during which the digging operation is being performed, based on a weather condition in the geographic area, based on an amount of usage of machine 105, among other examples. As an example, with respect to the machine type, a cost (e.g., resources, complexity, and/or time) associated with replacing an implement of a first machine type (e.g., an excavator) may exceed a cost (e.g., resources, complexity, and/or time) associated with replacing an implement of a second machine type (e.g., a skid steer loader). In this regard, it may be more advantageous to minimize implement wear for the excavator than for the skid steer loader. Accordingly, a weight for the expected amount of implement wear may exceed weights for other metrics for the first machine type whereas a weight for the expected amount of implement wear may be less than weights for other metrics for the second machine type. That is, for work that can be done by at least two types of machines, the machine(s) that perform the work with lower operating costs may be used preferentially over the machine (s) that perform the work with higher costs. The above comparison between the different types of machines may be performed prior to a job starting, in a simulation or via a field trial. Once the job begins, a machine which was selected (as a result of the simulation) may be used. In some situations, the costs may be used to optimize path planning for the selected machine.

As another example, with respect to the geographic area, a ground surface in a first geographic area may be harder than a ground surface in a second geographic area. In this regard, it may be advantageous to ensure that implement wear is minimized in the first geographic area than in the second geographic area. Accordingly, a cost (or weighted cost) for the expected amount of implement wear may exceed costs (or weighted costs) for other metrics at the first geographic area whereas a cost (or weighted cost) for the expected amount of implement wear may be less than costs (or weighted costs) for other metrics at the second geographic area. The optimal path may be chosen which reduces implement wear, in which case the weight for the expected amount of implement wear may be increased for the first geographic area and the second geographic area.

As yet another example, with respect to the day and/or the time, a first day and/or a first time may be associated with an amount of daylight that exceeds an amount of daylight associated with a second day and/or a second time. In this regard, it may be advantageous to ensure that the digging operation is completed in a shorter amount of time during the second day and/or the second time than during the first day and/or the first day time. Accordingly, a weight for the expected amount of time for completing the digging operation may exceed weights for other metrics during the second day and/or the second time whereas a weight for the expected amount of time for completing the digging operation may be less than weights for other metrics during the first day and/or a first time. Controller 145 may obtain the expected metrics information from a memory of machine 105, from the back office system, from a device of the operator of machine 105, among other examples.

Controller 145 may cause wireless communication component 160 to transmit to the one or more remote computing devices 175, via the wireless connection, area information regarding the area of the ground surface. The area information may include information identifying dimensions of the area (e.g., a depth of the area, a diameter of the area, a length of the area, a width of the area, among other examples), a location of the area in the ground surface, a geometric shape of the area, among other examples. Alternatively, the one or more remote computing devices 175 may receive the area information from the back office system, the device of the operator of machine 105, from the one or more other machines 210, among examples.

The one or more remote computing devices 175 may receive the data, the external data, the expected metrics information, and/or the area information. The one or more remote computing devices 175 may process the data, the external data, the expected metrics information, and/or the area information to generate the digging information. When processing the data and/or the external data (hereinafter referred to as "data"), the one or more remote computing devices 175 may perform one or more operations (e.g., filtering operations) on the data. For example, the one or more remote computing devices 175 may process the data to remove or reduce an amount of noise (e.g., outlier data) from the data, and/or remove items that may be distorted in the data and that may cause a rendering of the data to be distorted, among other examples. For instance, the one or more remote computing devices 175 may perform filtering on the data (e.g., perform the filtering on the disparity map) to remove or reduce the amount of noise (e.g., outlier data), and/or remove the items, among other examples.

With respect to performing the filtering, the one or more remote computing devices 175 may process the data using spatial noise reduction filtering, temporal/time filtering, and/or digital signal processing techniques, among other examples. As a result of processing the data in this manner, the one or more remote computing devices 175 may enhance a resolution of the data (e.g., enhance a measure of smoothness of the data).

Additionally or alternatively to removing or reducing the noise and/or removing the items, the one or more remote computing devices 175 may process the data to remove image occlusion from the data. For example, the one or more remote computing devices 175 may use one or more computer vision techniques to identify and remove one or more items that may have occluded a line of sight of one or more stereo cameras 155. For instance, the one or more remote computing devices 175 may analyze the data using one or more object detection techniques (e.g., a Single Shot Detector (SSD) technique, a You Only Look Once (YOLO) technique, and/or the like) to identify the one or more items. Additionally or alternatively to removing the image occlusion, the one or more remote computing devices 175 may interpolate data in one or more portions of the data. As an example, the one or more remote computing devices 175 may perform image processing (e.g., using one or more image processing techniques) on the data to interpolate the data.

By performing the one or more operations described above, the one or more remote computing devices 175 may enhance a measure of quality of the data and increase a likelihood of identifying useful information that may facilitate an operation of machine 105. Based on performing the one or more operations described above, the one or more remote computing devices 175 may generate filtered data. The one or more remote computing devices 175 may process the filtered data (e.g., using a semantic segmentation technique) to determine information regarding one or more pits or trenches on the ground surface, information regarding one or more piles of material on the ground surface, information regarding the material, and/or information regarding the material in machine work tool 140, among other examples.

The information regarding the one or more pits or trenches may include a location of the one or more pits or trenches, a depth of the one or more pits or trenches, and/or a geometry (or shape) of the one or more pits or trenches, among other examples. The information regarding the one or more piles may include a location of the one or more piles, a height of the one or more piles, a geometry (or shape) of the one or more piles, and/or a volume of the one or more piles, among other examples. The information regarding the material may include a type of the material such as sand, clay, and/or hard rock, among other examples. The information regarding the material in machine work tool 140 may include a volume of the material, a geometry (or shape) of the material, and/or a fill level of machine work tool 140, among other examples. The information regarding the one or more pits or trenches, the information regarding the one or more piles, and/or the information regarding the material may be included in surface data.

The surface data may identify a current topography of the ground surface. The one or more remote computing devices 175 may compare the current topography of the ground surface and an expected topography of the ground surface after the digging operation to determine one or more first portions of the ground surface where material is to be removed, one or more second portions of the ground surface where material is to be added, among other examples. The expected topography may be identified by the area information.

Based on a result of comparing the current topography of the ground surface and the expected topography of the ground surface, the one or more remote computing devices 175 may identify a plurality of sequences of digging locations (along with paths between consecutive digging locations) and corresponding dumping locations. In some situations, the one or more remote computing devices 175 may evaluate the plurality of sequences of digging locations and corresponding dumping locations with respect to the expected metrics information. For instance, a first sequence (of the plurality of sequences) may satisfy the expected amount of time for each dig cycle, a second sequence (of the plurality of sequences) may satisfy the expected volume of material to be removed during each dig cycle, a third sequence (of the plurality of sequences) may satisfy the expected amount of time for completing the digging operation in the area, a fourth sequence (of the plurality of sequences) may satisfy the expected amount of fuel to be consumed during each dig cycle and/or during the digging operation, a fifth sequence (of the plurality of sequences) may satisfy the expected amount of time for each dig cycle and the expected amount of fuel to be consumed during each dig cycle and/or during the digging operation, and so on.

The one or more remote computing devices 175 may evaluate the plurality of sequences of digging locations and corresponding dumping locations and may identify an optimal sequence of digging locations and corresponding dumping locations, "optimal" meaning a sequence which offers one or more improvements with regard to the time, number of movements of the work machine, and/or fuel involved with completing the tasks, and/or the amount of material moved. The optimal sequence may be optimal because it is associated with a lowest total weighted cost out of total weighted costs of the plurality of sequences. The one or more remote computing devices 175 may identify the plurality of sequences of digging locations and corresponding dumping locations and identify the optimal sequence of digging locations and corresponding dumping locations using a machine learning model. For example, the one or more remote computing devices 175 may provide, as an input to the machine learning model, the data, the area information, the expected metrics information, among other examples. The machine learning model may identify (or predict) a sequence (e.g., a best sequence) of digging locations and corresponding dumping locations based on the input. The predicted sequence may be one in which parameters (of the machine learning model) may have been chosen to minimize a loss function used during training of the machine learning model. The loss function may encode many of the same weighted costs that a numerical optimization may consider. The machine learning model may provide, as an output, the optimal sequence of digging locations and corresponding dumping locations.

The machine learning model may be trained using historical data of ground surfaces (e.g., historical images of ground surfaces, historical disparity maps of ground surfaces, and/or historical point clouds of ground surfaces), historical dimensions of areas (e.g., historical depths, historical diameters, among other examples), historical expected metrics information regarding historical digging operations, among other examples. The machine learning model may be trained in a manner similar to the manner described above. Additionally or alternatively to using the machine learning model, the one or more remote computing devices 175 may use one or more numerical optimization models, one or more graph search algorithms, one or more heuristic algorithms, one or more coverage path planning algorithms, among other examples.

The one or more remote computing devices 175 may generate the digging information based on the optimal sequence. In some examples, the digging information may include information identifying a sequence of digging locations (e.g., geographical locations) and paths between consecutive digging locations, information identifying corresponding dumping locations (e.g., geographical locations), information identifying a manner for dumping material at each dumping location, suggested machine pose data identifying an orientation of machine 105 at each digging location, suggested implement pose data identifying a position and/or an orientation of machine work tool 140 at each digging location, suggested linkage pose data identifying a position and/or an orientation of boom 130 and/or stick 135 at each digging location, information identifying a volume of material to be dug (or removed) at each digging location, the surface data, among other examples.

Wireless communication component 160 may receive, via the wireless connection, the digging information from the one or more remote computing devices 175 and may provide the digging information to controller 145 to facilitate the digging operation. As an example, based on the digging information, controller 145 may cause machine 105 to navigate to a first digging location of the digging locations. When machine 105 is located at the first digging location, controller 145 may cause an orientation of machine 105 (e.g., an orientation of machine body 115) to be adjusted based on the suggested machine pose data. For example, controller 145 may cause the orientation of machine 105 to match the orientation of machine 105 at the first digging location. For instance, machine 105 may move to a position A, then counter-rotates ground engaging members 110 (e.g., tracks) so that machine 105 can face an orientation O and begin digging at an orientation O'. Alternatively, machine 105 may move to the position A and use a planned route that puts machine 105 at the orientation O' when machine 105 arrives at the position A. After arriving at the position A, machine 105 may begin digging at the orientation O'. Similarly, controller 145 may cause an orientation and/or a position of the linkage to be adjusted based on the suggested linkage pose data and/or may cause an orientation and/or a position of machine work tool 140 to be adjusted based on the suggested implement pose data.

After the adjustments, controller 145 may cause machine 105 to initiate and complete the digging operation at the first digging location and proceed toward a second digging location, of the digging locations, along the path between the first digging location and the second digging location. After initiating the digging operation, controller 145 may cause wireless communication component 160 to transmit additional data regarding the ground surface (e.g., obtained by one or more stereo cameras 155) to the one or more remote computing devices 175. Additionally, or alternatively, controller 145 may cause wireless communication component 160 to transmit the machine pose data, the implement pose data, the linkage pose data, and/or current metrics information to the one or more remote computing devices 175.

The current metrics information may include volume information of a volume of material that has been removed by machine 105 during the digging operation, information identifying an amount of time elapsed during one or more dig cycles that have occurred, a measure of hardness of the ground surface during the digging operation (e.g., based on data from the hydraulic displacement sensor), a measure of moisture of the ground surface during the digging operation (e.g., based on data from the soil moisture sensor), among other examples.

Controller 145 may determine the volume of material based on one or more images included in the additional data. For example, controller 145 may use the one or more images to identify an area of interest (e.g., material in machine work tool 140, a pile of material at a dumping location corresponding to the first digging location, among other examples). For example, controller 145 may analyze the one or more images using one or more object detection techniques (e.g., a Single Shot Detector (SSD) technique, a You Only Look Once (YOLO) technique, PointNet, and/or the like) to identify the area of interest.

Controller 145 may generate a graphical representation of the area interest based on the one or more images (e.g., a two-and-a half dimensional graphical representation, a 3D graphical representation, among other examples). Controller 145 may determine a volume of the graphical representation using one or more computational models, one or more computational algorithms, and/or other machine algorithms that may be used to determine a volume of graphical representations. Controller 145 may determine the volume of material removed as the volume of the graphical representation. Alternatively, controller 145 may determine the volume of material removed as a volume derived from an inside surface of machine work tool 140, based on information identifying the volume derived from the inside surface. Controller 145 may obtain the information identifying the volume derived from the inside surface from a memory of machine 105, from the back office system, among other examples.

Controller 145 may cause wireless communication component 160 to transmit the additional data (from one or more stereo camera 155), the machine pose data, the implement pose data, the linkage pose data, and/or the current metrics information periodically (e.g., every thirty seconds, every minute, every other minute, among other examples) and/or based on a triggering event (e.g., after each dig cycle). Controller 145 may cause wireless communication component 160 to transmit the additional data (from one or more stereo cameras 155), the machine pose data, the implement pose data, the linkage pose data, and/or the current metrics information to cause the one or more remote computing devices 175 to determine whether the digging information is to be updated. As example, when determining whether the digging information is to be updated, the one or more remote computing devices 175 may determine whether a fill level of material in machine work tool 140 satisfies a threshold fill level. For instance, the additional data may include the one or more images of machine work tool 140 (obtained during one or more dig cycles at the first digging location) and the one or more remote computing devices 175 may analyze the one or more images to determine the fill level of machine work tool 140.

In some situations, the one or more remote computing devices 175 may analyze the one or more images using one or more computational models, one or more computational algorithms, and/or other machine algorithms that may be used to determine a volume (e.g., a volume of material in machine work tool 140). The one or more remote computing devices 175 may determine that the digging information is to be updated if the one or more remote computing devices 175 determine that the fill level of material in machine work tool 140 does not satisfy the threshold fill level or if the volume does not satisfy a threshold volume. In other words, the one or more remote computing devices 175 may determine that the digging information is to be updated if the one or more remote computing devices 175 determine that machine work tool 140 is not digging a sufficient amount of material.

Assume that the one or more remote computing devices 175 determines that the fill level of material does not satisfy the threshold fill level, the one or more remote computing devices 175 may update the suggested implement pose data, the suggested linkage pose data, and/or the suggested machine pose data. The one or more remote computing devices 175 may perform the updates to cause machine 105 to improve the volume of material moved during a dig cycle (e.g., at the first digging location and/or at the second digging location). In some situations, based on the updates, controller 145 may transmit instructions to the one or more other machines 210 to cause the one or more other machines 210 to autonomously navigate to a current location of machine 105 and move an additional amount of material, thereby improving the volume of material moved.

The one or more remote computing devices 175 may perform similar adjustments based on the measure of hardness of the ground surface and/or a measure of moisture of the ground surface. Assume that the one or more remote computing devices 175 analyzes the additional data and determines that the digging operation has created obstacles along the path between the first digging location and the second digging location. The one or more remote computing devices 175 may update the sequence of digging locations and corresponding dumping locations to add and/or remove a digging location and/or a dumping location.

In some situations, the one or more remote computing devices 175 may determine a current (and/or expected) weather at a current job site of machine 105 and may update the digging information based on the current (and/or expected) weather. For example, if the one or more remote computing devices 175 determine that the current (and/or expected) weather at the current job site is not favorable with respect to the digging operation, the one or more remote computing devices 175 may identify a different job site. The different job site may be a next job site in a sequence of job sites for machine 105 or may be a job site that is not included in the sequence of job sites. The one or more remote computing devices 175 may include information identifying the different job site, in the updated digging information, to cause machine 105 to suspend the digging operation at the current job site and navigate to the different job site.

The one or more remote computing devices 175 may generate the updated digging information based on one or more of the adjustments discussed above. As an example, the updated digging information may include updated sequence of digging locations, updated information identifying corresponding dumping locations, updated information identifying a manner for dumping material at each dumping location, updated suggested machine pose data identifying an orientation of machine 105 at each digging location, updated suggested implement pose data identifying a position and/or an orientation of machine work tool 140 at each digging location, updated suggested linkage pose data identifying a position and/or an orientation of boom 130 and/or stick 135 at each digging location, updated surface data, among other examples. The one or more remote computing devices 175 may transmit the updated digging information and wireless communication component 160 may receive the updated digging information. Controller 145 may cause machine 105 to adjust the digging operation based on the updated digging information, in a manner similar to the manner described above.

In some situations, wireless communication component 160 may transmit the data as a continuous flow of data to cause the one or more remote computing devices 175 to continuously update the digging information and continuously provide the updated digging information. Wireless communication component 160 may continuously receive the updated digging information from the one or more remote computing devices 175. Controller 145 may use the updated digging information to dynamically adjust, in real time or in near real time, an operation of machine 105. For example, controller 145 may cause machine 105 to navigate to an updated digging location from a current digging location, adjust of the position and/or an orientation of machine 105, adjust of the position and/or an orientation of boom 130, adjust of the position and/or an orientation of stick 135, and/or adjust of the position and/or an orientation of machine work tool 140.

In some situations, the surface data and/or the updated surface data may be used by machine 105 to facilitate navigation of machine 105 in the environment (e.g., to facilitate an autonomous navigation or a semiautonomous navigation). For example, the surface data and/or the updated surface data may be used by machine 105 to identify one or more navigable portions of the environment and identify one or more non-navigable portions of the environment. As an example, the one or more navigable portions may include one or more portions of the ground surface that do not include the one or more pits, and/or that do not include the one or more piles, among other examples. The one or more non-navigable portions may include one or more portions of the ground surface that include the one or more pits, and/or the one or more piles, among other examples of items that may obstruct a navigation operation of machine 105. In this regard, the surface data may be used for an autonomous (or semi-autonomous) navigation operation of machine 105. Controller 145 may use the surface data and/or the updated surface data to cause machine 105 to navigate from one digging location to another digging location, from a current location associated with the job site to a destination location associated with another job site, among other examples.

In some implementations, controller 145 may cause data (e.g., received from one or more stereo cameras 155, one or more sensor devices 165, the one or more other machines 210, among other examples) to be stored when the wireless connection is not viable. For example, assume that controller 145 determines that the wireless connection is not viable as described above and that controller 145 receives the data after determining that the wireless connection is not viable. Based on determining that the wireless connection is not viable, controller 145 may cause the data to be stored (or buffered) locally for a threshold amount of time. In some examples, controller 145 may cause the data to be buffered locally using a circular buffer (or ring buffer), a single buffer, a double buffer, among other examples.

After the threshold amount of time has expired, controller 145 may determine whether the wireless connection is viable (as described above). Assume that controller 145 determines that the wireless connection is viable after the threshold amount of time. Controller 145 may cause the buffered data to be transmitted to the one or more remote computing devices 175 (as described above) based on determining that the wireless connection is viable after the threshold amount of time. In some instances, if controller 145 determines that the wireless connection is not viable after the threshold amount of time, controller 145 may cause the data to be processed locally as explained below.

In some implementations, controller 145 may cause machine 105 to suspend the digging operation when the wireless connection is not viable (e.g., not viable for a threshold amount of time after transmitting the data). For example, assume that controller 145 determines that the wireless connection is not viable (as described above) and that the digging information has not been received from the one or more remote computing devices 175. Controller 145 may cause machine 105 to suspend the digging operation based on determining that the digging information has not been received. The digging operation may be suspended until wireless communication component 160 re-establishes the wireless connection and receives, via the wireless connection, the digging information. Alternatively to suspending the digging operation, controller 145 may cause machine 105 to reduce a speed at which the digging operation is performed.

In some implementations, controller 145 may cause the data (e.g., from one or more stereo cameras 155), the external data (e.g., from the one or more other machines 210), the expected metrics information, and/or the area information to be processed locally for one or more of the reasons described above. As an example, controller 145 may cause wireless communication component 160 to terminate the wireless connection or cause wireless communication component 160 to not attempt to establish the wireless connection (e.g., when the wireless connection is not viable), thereby causing data processing to be performed locally. Controller 145 may generate a notification indicating that the data, the expected metrics information, and/or the area information are being processed locally. The notification may be provided to a device of the operator, to the back office, to devices of operators of the one or more other machines 210, among other examples.

Controller 145 may process the data, the external data, the expected metrics information, and/or the area information to generate machine digging information, in a manner similar to the manner described above with respect to the one or more remote computing devices 175 processing the data. In some instances, due to the computational constraints of machine 105, the machine digging information may be less accurate than the digging information generated by the one or more remote computing devices 175.

In some situations, controller 145 may compare the area information and information regarding one or more other areas that have been excavated. The information regarding each of the one or more other areas may be stored, in a memory of machine 105, in association with corresponding digging information.

In some examples, controller 145 may determine (e.g., periodically and/or based on a triggering event) whether wireless communication component 160 is able to establish the wireless connection, in a manner similar to the manner described above. For example, after determining that the wireless connection is not viable, controller 145 may determine (e.g., periodically and/or based on a triggering event) whether wireless communication component 160 is able to re-establish the wireless connection. Controller 145 may cause wireless communication component 160 is to establish the wireless connection based on determining that wireless communication component 160 is able to re-establish the wireless connection. Wireless communication component 160 may establish the wireless connection as described above.

In some situations, algorithms (used by the one or more remote computing devices 175 to perform the actions discussed above) may be updated on the one or more remote computing devices 175 with no or minimal downtime for machine 105. For example, the algorithms may be updated with new features, tools, and/or information to collect new information from existing sensors of machine 105. In this regard, additional value (or functionality) may be added to machine 105 without retrofitting machine 105 with new hardware to process data differently or with no or minimal downtime for machine 105.

With respect to updating the algorithms, once new algorithms (e.g., for noise/artifact removal, feature extraction, machine learning model training, among other examples) have been developed and validated on a non-production machine, the new algorithms may be introduced to production machines in different ways. In one example, the new algorithms can be replaced (on the one or more remote computing devices 175) under same identifier(s) as identifier (s) of old corresponding algorithms so that existing machines, which send data (to the one or more remote computing devices 175 for processing), may perceive improvements immediately on upon request. This process is a continuous integration style update on a server side only (e.g., on the one or more remote computing devices 175 side only) and affects all machines which use the one or more remote computing devices 175 for remote processing.

As another example, the new algorithms can be replaced (on the one or more remote computing devices 175) under new identifier(s), and existing machines may have their on-board software flashed with an update that sends requests to the new identifier(s). This process is a continuous integration style update on a server side only (e.g., on the one or more remote computing devices 175 side only) and a software distribution update on the client side (e.g., on machine 105 side). No hardware changes are needed but new software must be pushed to the machines. This process can be used to manage which machines are upgraded with minimal downtime.

As yet another example, the new algorithms can be provided (on the one or more remote computing devices 175) under new identifier(s), and existing machines can have their existing on-board software configured to use the new identifier(s), for example through a manual change made through a display. This process is a continuous integration style update on the server side and a software configuration change on the client side. No hardware changes are needed for machine 105. This processing can be used to manage which machines are upgraded with almost no downtime.

The number and arrangement of devices shown in FIG. 2 are provided as an example. In practice, there may be additional devices, fewer devices, different devices, or differently arranged devices than those shown in FIG. 2. Furthermore, two or more devices shown in FIG. 2 may be implemented within a single device, or a single device shown in FIG. 2 may be implemented as multiple, distributed devices. Additionally, or alternatively, a set of devices (e.g., one or more devices) of system 200 may perform one or more functions described as being performed by another set of devices of system 200.

Figure 3:
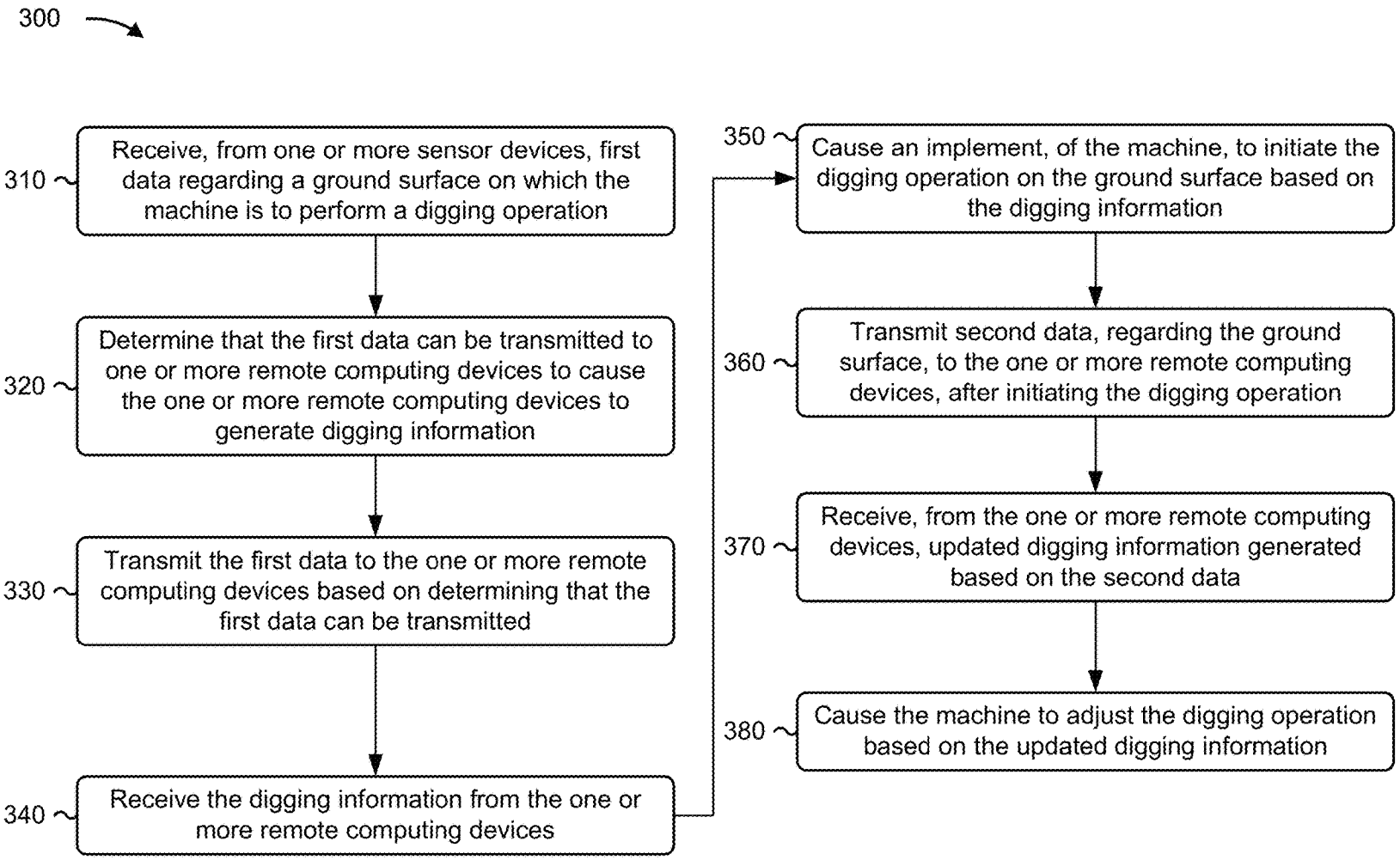
FIG. 3 is a flowchart of an example process relating to remote processing of data to generate digging information.

FIG. 3 is flowchart of an example process 300 relating to remote processing of data to generate digging information. One or more process blocks of FIG. 3 may be performed by a controller (e.g., controller 145). One or more process blocks of FIG. 3 may be performed by another device or a group of devices separate from or including the device, such as one or more stereo cameras (e.g., one or more stereo cameras 155), a wireless communication component (e.g., wireless communication component 160), a satellite device (e.g., satellite device 170), one or more remote computing devices (e.g., one or more remote computing devices 175), and/or a base station (e.g., base station 180).

As shown in FIG. 3, process 300 may include receiving, from one or more sensor devices, first data regarding a ground surface on which the machine is to perform a digging operation (block 310). For example, the controller may receive, from one or more sensor devices, first data regarding a ground surface on which the machine is to perform a digging operation, as described above.

The one or more sensor devices include at least one of one or more stereo cameras, or one or more light detection and ranging (LIDAR) devices, and wherein the one or more remote computing devices include one or more cloud computing devices.

Receiving the first data comprises receiving data from one or more first sensor devices of the machine, and, optionally, receiving data from one or more second sensor devices of one or more machines that are separate from the machine.

As further shown in FIG. 3, process 300 may include determining that the first data can be transmitted to one or more remote computing devices to cause the one or more remote computing devices to generate digging information (block 320). For example, the controller may determine that the first data can be transmitted to one or more remote computing devices to cause the one or more remote computing devices to generate digging information, as described above.

As further shown in FIG. 3, process 300 may include transmitting the first data to the one or more remote computing devices based on determining that the first data can be transmitted (block 330). For example, the controller may transmit the first data to the one or more remote computing devices based on determining that the first data can be transmitted, as described above.

As further shown in FIG. 3, process 300 may include receiving the digging information from the one or more remote computing devices, wherein the digging information includes information identifying a sequence of digging locations and information identifying corresponding dumping locations (block 340). For example, the controller may receive the digging information from the one or more remote computing devices, wherein the digging information includes information identifying a sequence of digging locations and information identifying corresponding dumping locations, as described above. The digging information includes information identifying a sequence of digging locations and information identifying corresponding dumping locations.

The digging information further comprises suggested implement pose data identifying a position and an orientation of the implement of the machine for each dumping location of a subset of the dumping locations, and wherein the method further comprises causing the position and the orientation of the implement to be adjusted, during a dumping operation at each dumping location of the subset of the dumping locations, based on the suggested implement pose data.

As further shown in FIG. 3, process 300 may include causing an implement, of the machine, to initiate the digging operation on the ground surface based on the digging information (block 350). For example, the controller may cause an implement, of the machine, to initiate the digging operation on the ground surface based on the digging information, as described above.

The digging information further comprises suggested implement pose data identifying a position and an orientation of the implement of the machine at each digging location of a subset of the digging locations, and wherein the method further comprises causing the position and the orientation of the implement to be adjusted, prior to the digging operation at each digging location of the subset of the digging locations, based on the suggested implement pose data.

The digging information further comprises suggested machine pose data identifying an orientation of the machine at each digging location of a subset of the digging locations, and wherein the method further comprises causing the orientation of the machine to be adjusted, prior to the digging operation at each digging location of the subset of the digging locations, based on the suggested machine pose data.

As further shown in FIG. 3, process 300 may include transmitting second data, regarding the ground surface, to the one or more remote computing devices, after initiating the digging operation (block 360). For example, the controller may transmit second data, regarding the ground surface, to the one or more remote computing devices, after initiating the digging operation, as described above.

As further shown in FIG. 3, process 300 may include receiving, from the one or more remote computing devices, updated digging information generated based on the second data (block 370). For example, the controller may receive, from the one or more remote computing devices, updated digging information generated based on the second data, as described above.

As further shown in FIG. 3, process 300 may include causing the machine to adjust the digging operation based on the updated digging information (block 380). For example, the controller may cause the machine to adjust the digging operation based on the updated digging information, as described above.

Process 300 includes receiving, from the one or more sensor devices and after performing the digging operation, third data of an environment that includes the ground surface, transmitting the third data to the one or more remote computing devices to cause the one or more remote computing devices to generate navigation information from a current location of the machine to a destination location, wherein the current location is associated with a first job site and the destination location is associated with a second job site, receiving the navigation information from the one or more remote computing devices, and causing the machine to navigate from the current location to the destination location.

Although FIG. 3 shows example blocks of process 300, in some implementations, process 300 may include additional blocks, fewer blocks, different blocks, or differently arranged blocks than those depicted in FIG. 3. Additionally, or alternatively, two or more of the blocks of process 300 may be performed in parallel.

INDUSTRIAL APPLICABILITY

The present disclosure is directed to a machine that determines whether to cause one or more remote computing devices to process data (one or more sensor devices of the machine) to generate digging information that is used by the machine for autonomous performance of a digging operation. The data may include data regarding a ground surface on which the machine is to perform the digging operation. The one or more sensor devices may be provided on different portions of the machine (e.g., provided a boom, a stick, and/or an implement). As an example, the data may include one or more images of the ground surface and the one or more sensor devices may include, for example, one or more stereo cameras. The data may be transmitted to the one or more remote computing devices via a satellite device configured for high-speed communication or via a cellular network configured for high-speed communication (e.g., a 5G network).

Determining the digging information, as part of planning a digging operation, is a computationally complex and time-consuming task that requires high-performance computing resources. Determining the digging information, using typical limited computing resources of the machine, presents several issues. For example, typical computing resources, of the machine, may generate digging information of reduced accuracy and/or reduced quality with respect to the digging information generated by high-performance computer resources.

Moreover, using the typical computing devices, to determine the digging information, can consume an excessive amount of computing resources of the machine and can take an excessive amount of computing time. Such computing resources may be needed for other operations to be performed by the machine. The excessive computing time may cause the machine to be idle for a long period of time waiting for the computations to be complete, thereby reducing productivity of the machine. In some situations, the computations may be terminated prematurely in order to save time (e.g., to preserve computing time), in which case sub-optimal paths may be selected. Alternatively, no path may be selected, thereby producing errors. The selection of sub-optimal paths (or no path) may result in poor machine performance or failures. Accordingly, using the typical computing resources, to determine the digging information may prevent the machine from performing the other operations. Furthermore, the excavator may be used in rugged and harsh conditions that may subject the typical computing devices to premature failures, thereby preventing the planning information from being determined. The present disclosure resolves these issues.

For example, by transmitting the data to the one or more remote computing devices for processing, the digging information of the present disclosure provides an improvement of accuracy, timeliness, and quality with respect to data generated using the typical limited computing resources of the machine. In this regard, the digging information may improve an accuracy of the digging operation performed by the machine, may improve a precision of the digging performed by the machine, may improve a speed of the digging operation performed by the machine, may improve an efficiency of the digging operation performed by the machine, may shorten an amount of time it takes to identify the most optimal path, among other examples. Furthermore, by using a satellite device configured for high-speed communication or a cellular network configured for high-speed communication to communicate with the one or more remote computing devices, the machine may receive the digging information in a manner that may enable the machine to make adjustments, in real-time or near real-time, during the digging operation.

Moreover, the one or more remote computing devices are not subject to the rugged and harsh conditions of a worksite and, accordingly, are not subject to premature failures. Additionally, by transmitting the data to the one or more remote computing devices for processing, the machine preserves limited computing resources that would have otherwise been consumed by the typical computing resources when processing the images.

The foregoing disclosure provides illustration and description, but is not intended to be exhaustive or to limit the implementations to the precise forms disclosed. Modifications and variations may be made in light of the above disclosure or may be acquired from practice of the implementations. Furthermore, any of the implementations described herein may be combined unless the foregoing disclosure expressly provides a reason that one or more implementations cannot be combined. Even though particular combinations of features are recited in the claims and/or disclosed in the specification, these combinations are not intended to limit the disclosure of various implementations. Although each dependent claim listed below may directly depend on only one claim, the disclosure of various implementations includes each dependent claim in combination with every other claim in the claim set.

As used herein, "a," "an," and a "set" are intended to include one or more items, and may be used interchangeably with "one or more." Further, as used herein, the article "the" is intended to include one or more items referenced in connection with the article "the" and may be used interchangeably with "the one or more." Further, the phrase "based on" is intended to mean "based, at least in part, on" unless explicitly stated otherwise. Also, as used herein, the term "or" is intended to be inclusive when used in a series and may be used interchangeably with "and/or," unless explicitly stated otherwise (e.g., if used in combination with "either" or "only one of"). Further, spatially relative terms, such as "below," "lower," "above," "upper," and the like, may be used herein for ease of description to describe one element or feature's relationship to another element(s) or feature(s) as illustrated in the figures. The spatially relative terms are intended to encompass different orientations of the apparatus, device, and/or element in use or operation in addition to the orientation depicted in the figures. The apparatus may be otherwise oriented (rotated 90 degrees or at other orientations) and the spatially relative descriptors used herein may likewise be interpreted accordingly.

What is claimed is:

1. A method performed by a controller of a machine, the method comprising:

receiving, from one or more sensor devices, first data regarding a ground surface on which the machine is to perform a digging operation;

determining that the first data can be transmitted to one or more remote computing devices to cause the one or more remote computing devices to generate digging information;

transmitting the first data to the one or more remote computing devices based on determining that the first data can be transmitted;

receiving the digging information from the one or more remote computing devices, wherein the digging information includes information identifying a sequence of digging locations and information identifying corresponding dumping locations;

causing an implement, of the machine, to initiate the digging operation on the ground surface based on the digging information;

transmitting second data, regarding the ground surface, to the one or more remote computing devices, after initiating the digging operation;

receiving, from the one or more remote computing devices, updated digging information generated based on the second data; and causing the machine to adjust the digging operation based on the updated digging information.

2. The method of claim 1, wherein receiving the first data comprises:

receiving data from one or more first sensor devices of the machine; and receiving data from one or more second sensor devices of one or more machines that are separate from the machine.

3. The method of claim 1, wherein the digging information further comprises suggested implement pose data identifying a position and an orientation of the implement of the machine at each digging location of a subset of the digging locations; and wherein the method further comprises:

causing the position and the orientation of the implement to be adjusted, prior to the digging operation at each digging location of the subset of the digging locations, based on the suggested implement pose data.

4. The method of claim 1, wherein the digging information further comprises suggested machine pose data identifying an orientation of the machine at each digging location of a subset of the digging locations; and wherein the method further comprises:

causing the orientation of the machine to be adjusted, prior to the digging operation at each digging location of the subset of the digging locations, based on the suggested machine pose data.

5. The method of claim 1, wherein the digging information further comprises suggested implement pose data identifying a position and an orientation of the implement of the machine for each dumping location of a subset of the dumping locations; and wherein the method further comprises:

causing the position and the orientation of the implement to be adjusted, during a dumping operation at each dumping location of the subset of the dumping locations, based on the suggested implement pose data.

6. The method of claim 1, wherein the one or more sensor devices includes at least one of:

one or more stereo cameras, or one or more light detection and ranging (LIDAR) devices; and wherein the one or more remote computing devices includes:

one or more cloud computing devices.

7. The method of claim 1, further comprising:

receiving, from the one or more sensor devices and after performing the digging operation, third data of an environment that includes the ground surface;

transmitting the third data to the one or more remote computing devices to cause the one or more remote computing devices to generate navigation information from a current location of the machine to a destination location, wherein the current location is associated with a first job site and the destination location is associated with a second job site;

receiving the navigation information from the one or more remote computing devices; and causing the machine to navigate from the current location to the destination location.

8. A system comprising:

a controller configured to:

receive, from one or more sensor devices, data regarding a ground surface on which a machine is to perform a digging operation;

transmit the data to one or more remote computing devices to cause the one or more remote computing devices to generate digging information for the digging operation based on the data;

receive the digging information, from the one or more remote computing devices, based on the digging information, wherein the digging information includes information identifying a sequence of digging locations in an area of the ground surface and information identifying an orientation of the machine at each digging location of a subset of the digging locations; and based on the digging information:

cause the machine to navigate to a digging location of the subset of the digging locations and to be oriented in accordance with the orientation at the digging location, and cause an implement, of the machine, to perform the digging operation at the digging location.

9. The system of claim 8, wherein the digging location is a first digging location, and wherein the controller is further configured to:

transmit, to the one or more remote computing devices, volume information regarding a volume of material removed during the digging operation at the digging location, wherein the volume information is transmitted to cause the one or more remote computing devices to generate updated digging information;

receive the updated digging information from the one or more remote computing devices, wherein the updated digging information includes suggested implement pose data identifying a position and an orientation of the implement at a second digging location of the subset of the digging locations; and cause the position and the orientation of the implement to be adjusted, based on the suggested implement pose data, prior to the digging operation at the second digging location.

10. The system of claim 9, wherein the controller is further configured to:

receive, from the one or more sensor devices, one or more images of a bucket of the machine, wherein the volume information is based on the one or more images.

11. The system of claim 8, wherein the controller is further configured to:

transmit additional data, regarding the ground surface, to the one or more remote computing devices, after initiating the digging operation;

receive, from the one or more remote computing devices, updated digging information generated based on the additional data; and cause the machine to adjust the digging operation based on the updated digging information.

12. The system of claim 8, wherein the controller is configured to:

transmit additional data, regarding the ground surface, to the one or more remote computing devices, after initiating the digging operation, wherein the additional data is transmitted to cause the one or more remote computing devices to generate updated digging information;

determine that the updated digging information has not been received from the one or more remote computing devices within a threshold amount of time after transmitting the additional data; and based on determining that the updated digging information has not been received from the one or more remote computing devices, either:

cause the machine to suspend the digging operation; or cause the machine to reduce a speed at which the digging operation is performed.

13. The system of claim 8, wherein the controller, to transmit the data, is configured to:

transmit the data to the one or more remote computing devices for processing via at least one of:

a satellite device configured for high-speed communication, or a cellular network configured for high-speed communication.

14. The system of claim 8, wherein the controller is configured to:

receive, during the digging operation at the digging location, additional data from a sensor device of the machine, wherein the additional data indicates a measure of hardness of the ground surface at the digging location;

transmit, to the one or more remote computing devices, the additional data to cause the one or more remote computing devices to generate updated digging information based on the additional data;

receive the updated digging information from the one or more remote computing devices; and cause a position and an orientation of the implement to be adjusted, during the digging operation at the digging location, based on the updated digging information.

15. A machine, comprising:

an implement;

one or more sensor devices; and a controller configured to:

receive, from the one or more sensor devices, data regarding a ground surface on which the machine is to perform a digging operation;

transmit the data to one or more remote computing devices to cause the one or more remote computing devices to generate digging information based on the data;

receive the digging information from the one or more remote computing devices, wherein the digging information includes information identifying a sequence of digging locations in an area of the ground surface and information identifying corresponding dumping locations; and based on the digging information:

cause the machine to navigate to a digging location of the digging locations, and cause the implement to initiate the digging operation at the digging location.

16. The machine of claim 15, wherein the controller is further configured to:

cause one or more other sensor devices, separate from the machine, to transmit additional data regarding the ground surface, wherein the digging information is generated further based on the additional data.

17. The machine of claim 15, wherein the controller is further configured to:

receive, during the digging operation at the digging location, additional data from one or more other sensor devices, wherein the additional data indicates a measure of moisture of the ground surface at the digging location;

transmit, to the one or more remote computing devices, the additional data to cause the one or more remote computing devices to generate updated digging information based on the additional data;

receive the updated digging information from the one or more remote computing devices, wherein the updated digging information includes suggested implement pose data identifying a position and an orientation of the implement; and cause the position and the orientation of the implement to be adjusted, during the digging operation at the digging location, based on the suggested implement pose data.

18. The machine of claim 15, wherein the digging information further includes suggested machine pose data identifying an orientation of the machine at each digging location of a subset of the digging locations;

wherein the controller is further configured to:

cause the machine to be oriented in accordance with the orientation, at the digging location, identified by the digging information prior to initiating the digging operation at the digging location.

19. The machine of claim 15, wherein the controller is further configured to:

determine that transmission of additional data, regarding the ground surface, to the one or more remote computing devices has been interrupted, after initiating the digging operation; and based on determining that the transmission of the additional data has been interrupted, either:

cause the machine to suspend the digging operation; or cause the machine to reduce a speed at which the digging operation is performed.

20. The machine of claim 15, wherein the controller is further configured to:

transmit additional data, regarding the ground surface, to the one or more remote computing devices, after initiating the digging operation, wherein the additional data is transmitted to cause the one or more remote computing devices to generate updated digging information based on the additional data;

determine that the updated digging information has not been received from the one or more remote computing devices within a threshold amount of time after transmitting the additional data; and based on determining that the updated digging information has not been received from the one or more remote computing devices, either:

cause the machine to suspend the digging operation; or cause the machine to reduce a speed at which the digging operation is performed.

* * * * *